US005759021A

United States Patent [19]

Yamaguchi et al.

[11] Patent Number: 5,759,021

[45] Date of Patent: Jun. 2, 1998

[54] SCROLL TYPE COMPRESSOR HAVING AN ANNULAR INTAKE GROOVE FOR SUPPLYING LUBRICANT TO THE ROTATION PREVENTION MECHANISM

[75] Inventors: Motohiro Yamaguchi; Mikio Matsuda; Mitsuo Inagaki, all of Nishio; Shigeru Hisanaga, Kariya, all of Japan

[73] Assignees: Nippondenso Co., Ltd., Kariya; Nippon Soken, Inc., Nishio, both of Japan

[21] Appl. No.: 912,006

[22] Filed: Aug. 15, 1997

Related U.S. Application Data

[63] Continuation of Ser. No. 589,246, Jan. 23, 1996, abandoned.

[30] Foreign Application Priority Data

Jan. 23, 1995 [JP] Japan ..... 7-008373

[51] Int. Cl.[6] ..... F04C 18/04; F04C 29/02

[52] U.S. Cl. ..... 418/55.3; 418/55.6; 418/100

[58] Field of Search ..... 418/55.3, 55.6, 418/100

[56] References Cited

U.S. PATENT DOCUMENTS

| | | | |
|---|---|---|---|
| 4,484,869 | 11/1984 | Nakayama et al. | 418/86 |
| 4,538,975 | 9/1985 | Tsukagoshi | 418/55.6 |
| 5,141,422 | 8/1992 | Ito et al. | 418/55.3 |
| 5,423,663 | 6/1995 | Fukui | 418/55.3 |
| 5,542,829 | 8/1996 | Inagaki et al. | 418/55.3 |

FOREIGN PATENT DOCUMENTS

| | | | |
|---|---|---|---|
| 60-135684 | 7/1985 | Japan | 418/55.6 |
| 63-43424 | 11/1988 | Japan . | |
| 3294680 | 12/1991 | Japan | 418/55.3 |

*Primary Examiner*—John J. Vrablik

*Attorney, Agent, or Firm*—Cushman Darby & Cushman IP Group of Pillsbury Madison & Sutro LLP

[57] ABSTRACT

A scroll type compressor providing an intake groove of communicating an intake port of a fluid to be compressed such as a refrigerant and a sliding contact part of a rotation prevention mechanism in either one of the end surfaces of the front housing and the end plate of the rotor which are opposite to each other so as to enhance the reliability by reliably lubricating the sliding parts such as the rotation prevention mechanism of the scroll rotor, making the fluid to be compressed be taken into the compression portion through the intake groove, and supplying the lubricant contained in the fluid to be compressed to the sliding part such as the rotation prevention mechanism.

12 Claims, 7 Drawing Sheets

SCROLL TYPE COMPRESSOR HAVING AN ANNULAR INTAKE GROOVE FOR SUPPLYING LUBRICANT TO THE ROTATION PREVENTION MECHANISM

This is a continuation of application Ser. No. 08/589,246, filed on Jan. 23, 1996, which was abandoned upon the filing hereof.

BACKGROUND OF THE INVENTION

1. Field of the Invention

The present invention relates to a scroll type compressor suitable for use as a refrigerant compressor in an air-conditioning apparatus, for example, for an automobile, and more particularly relates to an apparatus for securing lubrication of a rotation prevention mechanism of a rotor in the scroll type compressor.

2. Description of the Related Art

The intake system of a scroll type compressor is in some cases structured so that a fluid to be compressed, for example, a refrigerant of an air-conditioning system, is directly taken into a compression portion formed by engagement of a rotor and stator. In some cases the compressor is structured such that the refrigerant is once introduced into a housing from a intake port formed in a front housing or the like in front of the compression portion and then taken into the compression portion by a by-passing flow path.

In the former intake system a sliding part, such as a bearing or a rotation prevention mechanism of the rotor, cannot be lubricated by a lubricant such as a refrigerator oil mixed in the refrigerant. Due to the necessity of specially providing an oil path and oil pump etc. for lubrication, the structure becomes complex.

In the case by the latter intake system, by mixing the lubricant in the refrigerant and circulating the same, sliding parts such as a bearing or rotation prevention mechanism provided in the flow path of the refrigerant can be easily lubricated. Where these sliding parts are a long distance from the flow path of the refrigerant or where they are isolated from the flow path of the refrigerant, the lubrication becomes insufficient which creates the possibility of seizure of the sliding parts due to the shortage of lubrication, and therefore, the reliability of the compressor is poor. This problem is accompanied by another problem that the uniform distribution of the lubricant to all sliding contact parts becomes difficult where the high load sliding contact parts having a relatively small contact area are scattered in location as in a type wherein the rotation prevention mechanism uses a plurality of pairs of rotation prevention pins, and therefore the solution becomes further difficult.

SUMMARY OF THE INVENTION

An object of the present invention is to solve the aforementioned problems in the related art and improve the scroll type compressor using the latter intake system so as to enable sufficient and reliable lubrication of the sliding portions by a lubricant mixed in the refrigerant, even with respect to the sliding parts of a rotation prevention mechanism that uses pairs of rotation prevention pins dispersed at positions away from the intake port.

As a means for achieving the aforesaid object, the present invention provides a scroll type compressor comprising a front housing; a rear housing fixed to the front housing; an intake port arranged in either of the front housing or the rear housing; a shaft which is rotatably supported by the front housing and provided with a crank portion eccentric by a predetermined amount; a rotor which is rotatably supported by the crank portion and provided with a spiral blade and end plate; a rotation prevention mechanism preventing the rotation of the rotor; and a stator which is provided with a spiral blade and end plate so that the spiral blade thereof is engaged with the spiral blade of the aforesaid rotor; and further an intake groove for intake of the fluid to be compressed which is formed in either one of the end surfaces of the front housing and the rotor which are opposite to each other and connect the intake port with the sliding contact part of the rotation prevention mechanism.

In the case of the present invention, the basic structure of the scroll type compressor and the structure of the rotation prevention mechanism per se are not characterizing features. The characterizing feature thereof resides in the provision of the intake groove for intake of the fluid to be compressed connecting the intake port with the rotation prevention mechanism in at least one of the end surfaces of the front housing and rotor of the scroll type compressor. Therefore, an explanation of the mode of operation concerning the non-characterizing part will be omitted.

In the scroll type compressor of the present invention, the rotation prevention mechanism comprising a plurality of pins constituted as pairs, rings having holes, balls, etc. is positively communicated with the intake port via the intake groove specially provided in at least one of the front housing and end plate of the rotor opposite to this, whereby at least a part of the fluid to be compressed such as the refrigerant taken into the housing is once conveyed to the rotation prevention mechanism by the intake groove, passes there, and then is taken into the compression portion formed by the rotor and stator. Therefore, during the passing, the lubricant such as the refrigerator oil contained in the fluid to be compressed will reliably lubricate the sliding parts of the rotation prevention mechanism. At this time, even if the sliding contact parts of the rotation prevention mechanism are scattered in location, they are communicated by a series of intake grooves formed on the end surface of the front housing or the end plate of the rotor opposite to this, and therefore it becomes possible to uniformly distributes the lubricant to the respective sliding contact parts. Also, by providing the branch path in the intake port and guiding the refrigerant to the bearings etc., the sliding parts of these bearings etc. can be lubricated.

Therefore, according to the present invention, it becomes possible to reliably lubricate the sliding parts of the rotation prevention mechanism or other sliding parts by an extremely simple means to prevent the seizure of the sliding parts and enhance the reliability of the scroll type compressor at a low cost.

BRIEF DESCRIPTION OF THE DRAWINGS

These and other objects and effects of the present invention will become apparent from the description of the preferred embodiments explained below with reference to the accompanying drawings, wherein:

FIG. 1 is a vertical cross-sectional front view showing a scroll type compressor according to a first embodiment of the present invention;

DESCRIPTION OF THE PREFERRED EMBODIMENTS

Figure 1A:
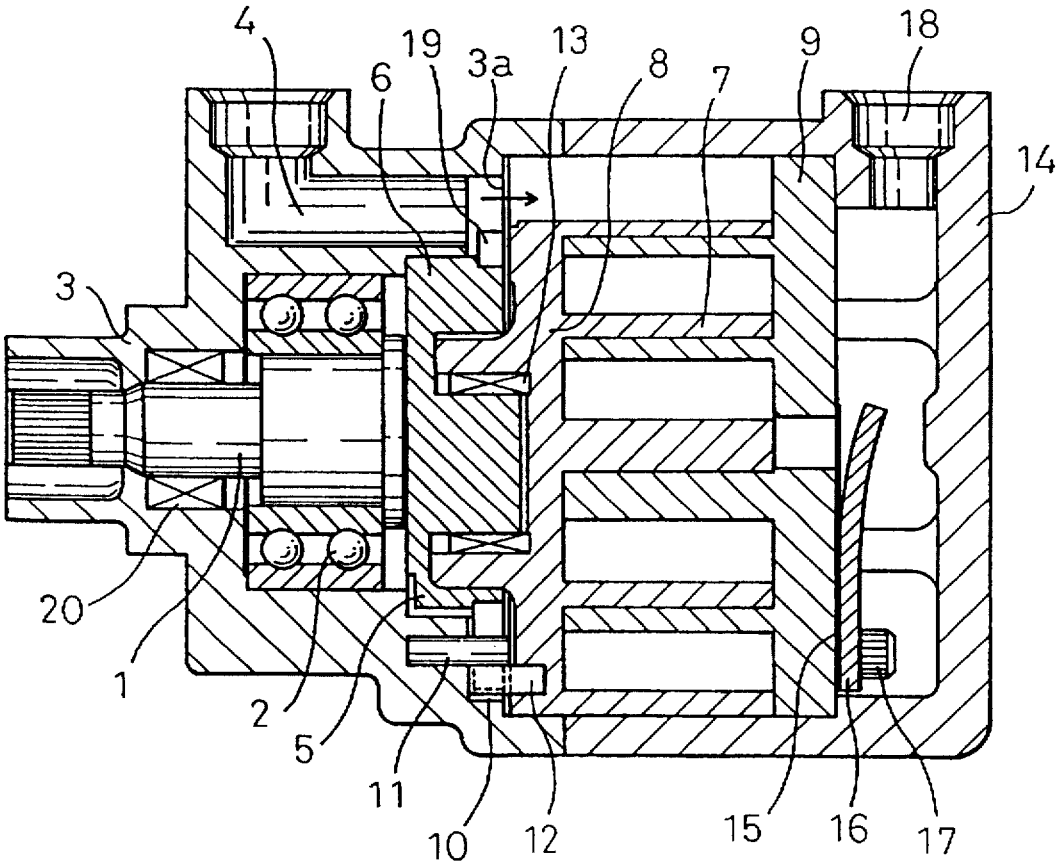
FIG. 1A is vertical cross-sectional view of the scroll type compressor shown in FIG. 1 with the rotor moved 180 degrees about its orbit from the position shown in FIG. 1.

As the first embodiment of the present invention, an explanation will be made of the structure of the scroll type compressor shown in FIG. 1.

A shaft 1 is rotatably attached to the front housing 3 via a main bearing 2. The shaft 1 has a weight portion 5 having a center of gravity on an axial line parallel to but away from the center line of the main bearing 2 and a crank portion 6 centered about an axial line which is similarly parallel to but away from the center line of the main bearing. A rotor 7 is rotatably installed at the crank portion 6 via the bearing 13. Here, the distance between the center line of the main bearing 2 and the center line of the crank portion 6 is called a radius of revolution. The rotor 7 performs the revolution movement by drawing a circle with a radius of the radius of revolution about the shaft 1 by the crank portion 6 when the shaft 1 starts the rotation. At this time, the rotor 7 is restricted from rotation with respect to the front housing 3 by the rotation prevention mechanism as will be explained later. In this way, the rotor 7 comes to perform only the revolution movement about the shaft 1 not accompanied by rotation.

In the case of this embodiment, in the previously mentioned rotation prevention mechanism, on the end surfaces of the front housing 3 and the rotor 7 which are opposite to each other, a plurality of pairs of rotation prevention pins 11 and 12 in the axial direction respectively having a radius of the same size as that of the radius of revolution are arranged in parallel so as to contact for each pair. At the same time, circular recesses 10 of the same number as the number of pairs of pins are formed in the thrust force receiving surface 3*a* of the front housing 3. The pairs of pins 11 and 12 are received in the recesses 10, whereby the pin 12 on the rotor 7 side can revolve around the pin 11 on the front housing 3 side in contact therewith.

A characteristic feature of the first embodiment is that the intake port 4 provided in the front housing 3 is communicated with the annular intake groove 19 formed in the circumferential direction of the end surface of the front housing 3 opposite to the end plate 8 of the rotor 7 on back of the axial direction of the main bearing 2. The intake groove 19 is communicated also with the circular recesses 10. An exhaust port 18 is opened in the rear housing 14, and the stator 9 is fixed by not illustrated bolts. The exhaust valve 15 and a stopper plate 16 are fixed to the stator 9 by the bolts 17. Note that, an oil seal 20 is disposed in a penetration portion of the shaft of the front housing 3 so that the refrigerant and the lubricant will not leak out.

Next, an explanation will be made of the operation of the first embodiment of the scroll type compressor of the present invention.

In the scroll type compressor, the fluid to be compressed may be directly taken into the compression portion constituted by the rotor 7 and the stator 9 or it may be taken from a position near the main bearing in front of the compression portion. In the former case, the refrigerant containing the lubricant such as the refrigerator oil is directly taken into the compression portion, and therefore the main bearing and the rotation prevention mechanism cannot be sufficiently lubricated. In the latter case, the main bearing can be lubricated, but the rotation prevention mechanism such as the rotation prevention pins 11 and 12 spaced apart from the intake port 4 still cannot be sufficiently lubricated.

In the first embodiment of the present invention, as shown in FIG. 1, not only is the intake or lubrication system of the latter form used, but also an annular intake groove 19 is provided on a surface of the front housing 3 so that the intake port 4 can be communicated with the circular recesses 10 in which the rotation prevention pins 11 and 12 are inserted. Due to this, the scroll type compressor of the first embodiment of the present invention performs the following characteristic operations.

Figure 2:
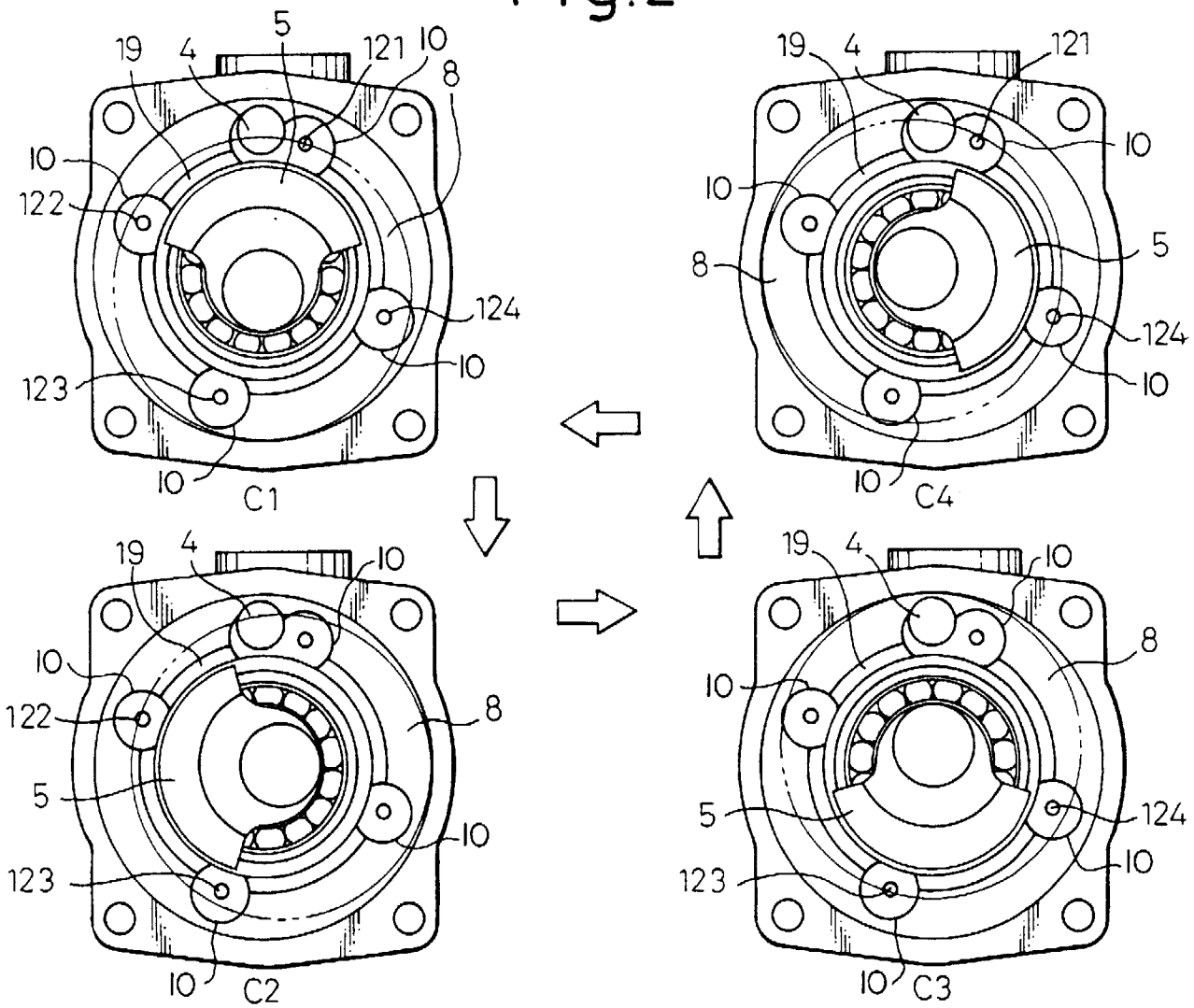
FIG. 2 is a horizontal cross-sectional side view showing four operation states of the first embodiment.
Figure 3:
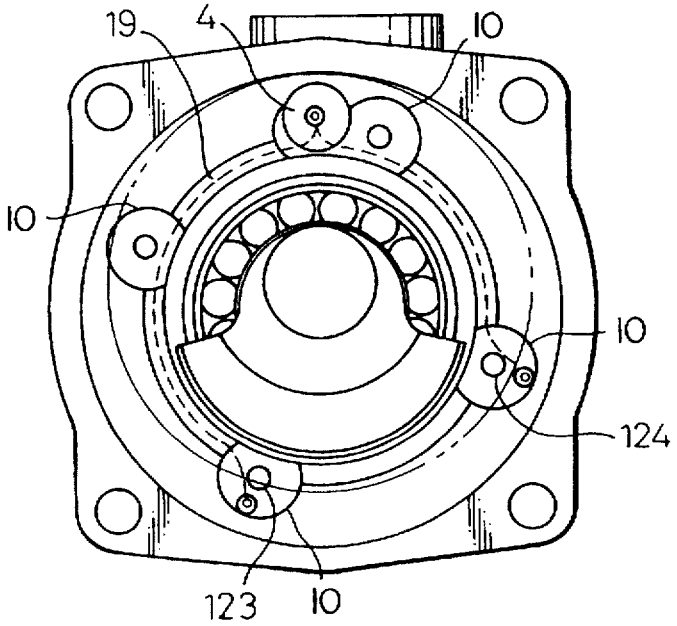
FIG. 3 is a horizontal cross-sectional side view for explaining the flow of the fluid to be compressed in the first embodiment.
Figure 4:
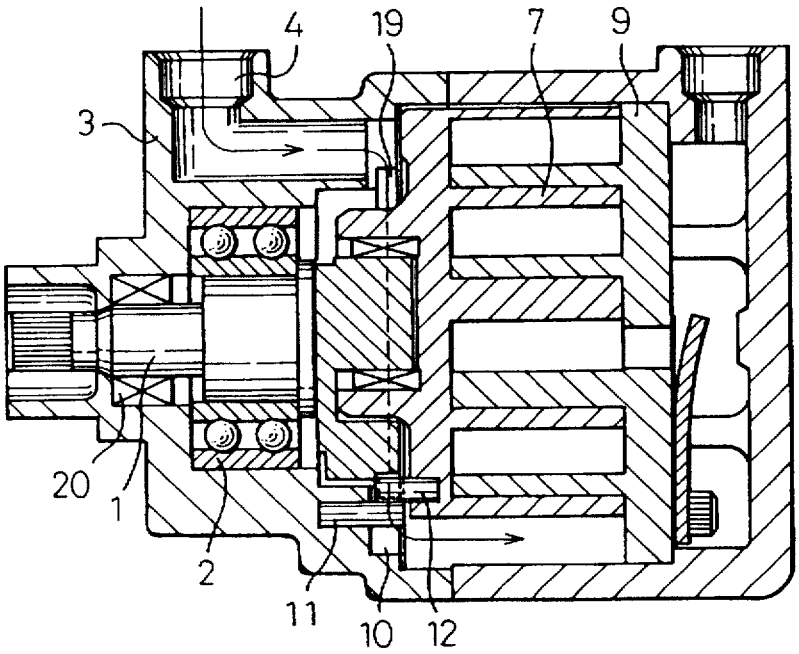
FIG. 4 is a vertical cross-sectional front view for explaining the flow of the fluid to be compressed in the first embodiment.

Although it is true also for the conventional scroll type compressor, when the shaft 1 is driven to rotate, the rotor 7 performs a revolution movement and moves in an order of C1→C2→C3→C4→C1 as shown by the change of position of the end plate 8 and the weight portion 5 in FIG. 2. Where the positional relationship between the intake port 4 and the rotor end plate 8 is in the state of C3, the intake port 4 is blocked axially by the end plate 8 as also shown in FIG. 1. A refrigerant flowing into the intake port 4 is blocked by end plate 8 from flowing axially and thus passes through a space formed by the intake groove 19, the shaft 1, and the rotor end plate 8 and is then taken into the compression chamber. The refrigerant flow through the annular groove 19 and around the rotation prevention pins 11 and 12 matched with the intake groove 19, that is the rotation prevention pins 121, 122, 123 and 124, and therefore the lubricant, such as the refrigerator oil mixed in the refrigerant, lubricates the sliding surface of the pins. Similarly, in the case of C2 and C4, when intake port 4 is only partially blocked by end plate 8, at least part of the refrigerant, including the lubricant mixed therewith, flows axially from intake port 4 directly into the compression portion defined by rotor 7 and stator 9 and part of the refrigerant flows into the annular groove 19 and the rotation prevention mechanism (i.e., pins 11 and 12). When the intake port 4 is substantially unblocked in the axial direction by end plate 8, as shown in case C1 of FIG. 2 and in FIG. 1A, most of the refrigerant flowing from intake port 4 flows in an axial direction directly into the compression portion defined by rotor 7 and stator 9 without passing through annular intake groove 19. As described above, the lubricant mixed in the refrigerant is uniformly distributed to all circular recesses 10 for a period where the compressor rotates one time, and effective lubrication between the rotation prevention pins 11 and 12 is carried out by that lubricant. FIG. 3 and FIG. 4 show the flow of the refrigerant in the case of C3 of FIG. 2 and the lubricant contained therein by an arrow of a solid line or a broken line.

Figure 5:
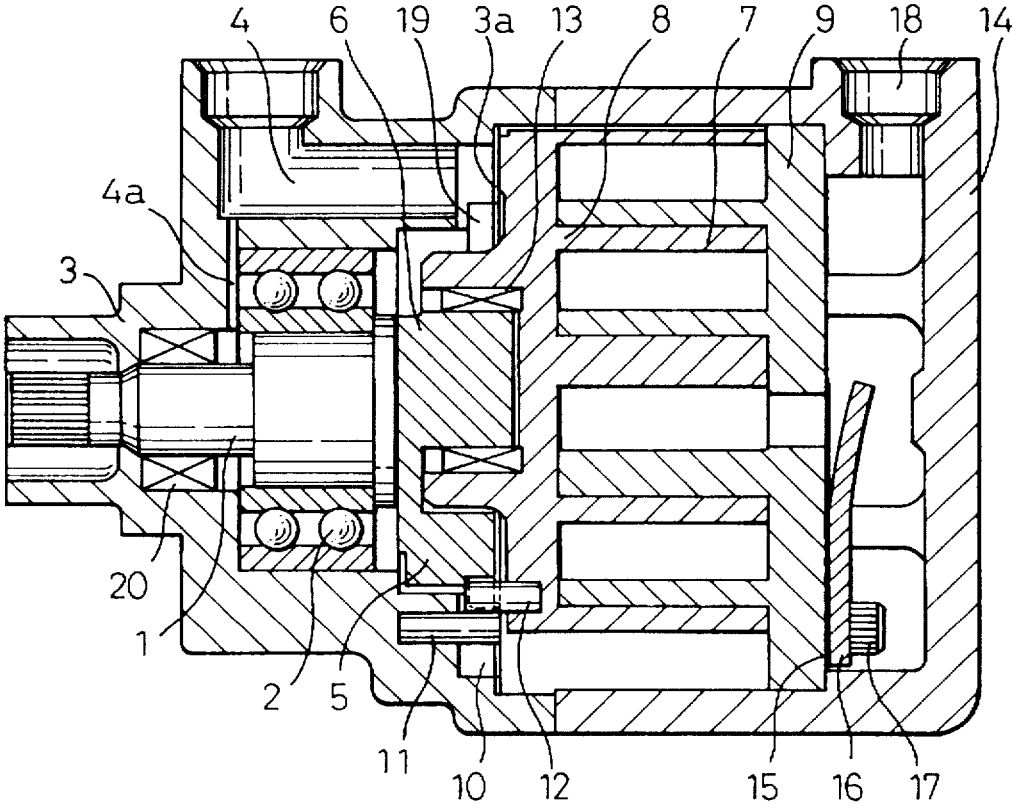
FIG. 5 is a vertical cross-sectional front view showing the scroll type compressor according to a second embodiment.
Figure 6:
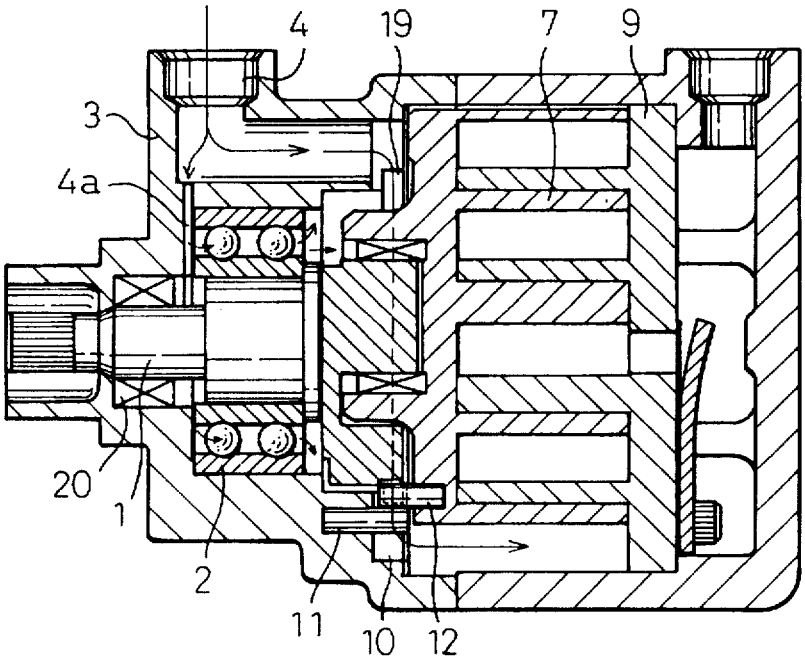
FIG. 6 is a vertical cross-sectional front view for explaining the flow of the fluid to be compressed in the second embodiment.

FIG. 5 and FIG. 6 show a second embodiment of the present invention. This example is characterized in that, in the same way as the case of the first embodiment, the intake port 4 provided in the front housing 3 is communicated with the annular intake groove 19 formed in the end surface of the front housing 3 opposite to the end plate 8 of the rotor 7, and the lubricant is supplied to the plurality of circular recesses 10 together with the refrigerant by the intake groove 19. In addition to this, an intake port 4a branched from the intake port 4 is provided in front of the main bearing 2, and this is communicated with the main bearing 2.

Accordingly, a part of the refrigerant flowing into the intake port 4 is branched and flows to the intake port 4a. This is combined again with the refrigerant flowing in the intake groove 19 after passing through the main bearing 2 and is taken into the compression portion formed between the rotor 7 and the stator 9. When a part of this refrigerant passes through the main bearing 2, the lubricant contained in the refrigerant more reliably lubricates and cools the main bearing 2 than the conventional one.

Figure 7:
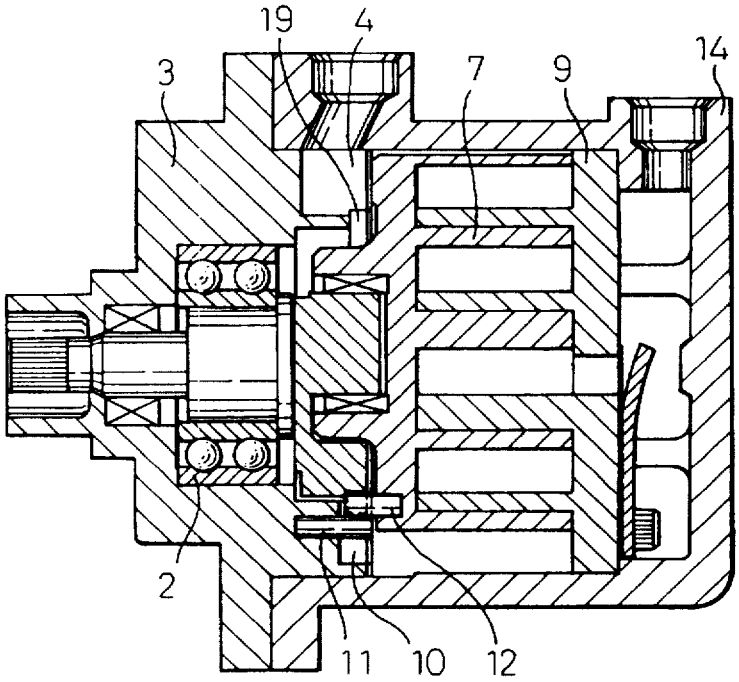
FIG. 7 is a vertical cross-sectional front view showing the scroll type compressor according to a third embodiment.

In the first and second embodiments, the intake port 4 was disposed in the front housing 3, but a similar effect can be exhibited even if the intake port 4 is disposed in the other housing, that is, a rear housing 14 in this case as in the third embodiment shown in FIG. 7.

Figure 8:
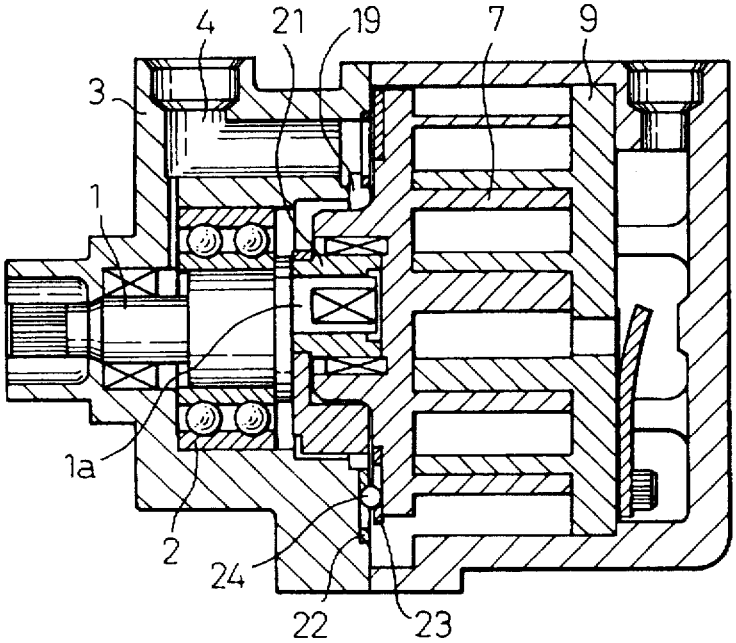
FIG. 8 is a vertical cross-sectional front view showing the scroll type compressor according to a fourth embodiment.

In the first to third embodiments, a rotation prevention mechanism using a crank having a constant eccentric distance of the rotor 7 with respect to the shaft 1, that is, the radius of revolution, and the pin 11 and pin 12 was used. A similar effect is exhibited by a rotation prevention mechanism known comprising a so-called driven crank mechanism consisting of an eccentric pin 1a of the shaft 1 and a balancer 21 and in which the radius of revolution of the rotor 7 is variable; a ball 24; and a pair of rings 22 and 23 having such holes that can pivot that ball 24 therein, as in the fourth embodiment shown in FIG. 8. Also, although not illustrated, it is true also for a case where a rotation prevention mechanism of the Oldham ring system is used.

Figure 9:
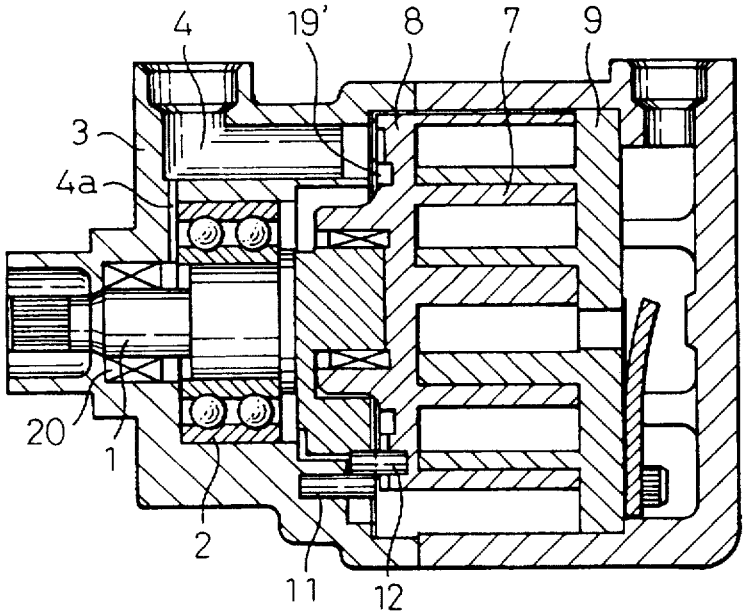
FIG. 9 is a vertical cross-sectional front view showing the scroll type compressor according to a fifth embodiment.

In the first to fourth embodiments, the intake groove 19 was disposed in the front housing 3, but a similar effect can be exhibited even if an intake groove 19' is annularly disposed in the end plate 8 of the rotor 7 as in the fifth embodiment shown in FIG. 9.

Figure 10:
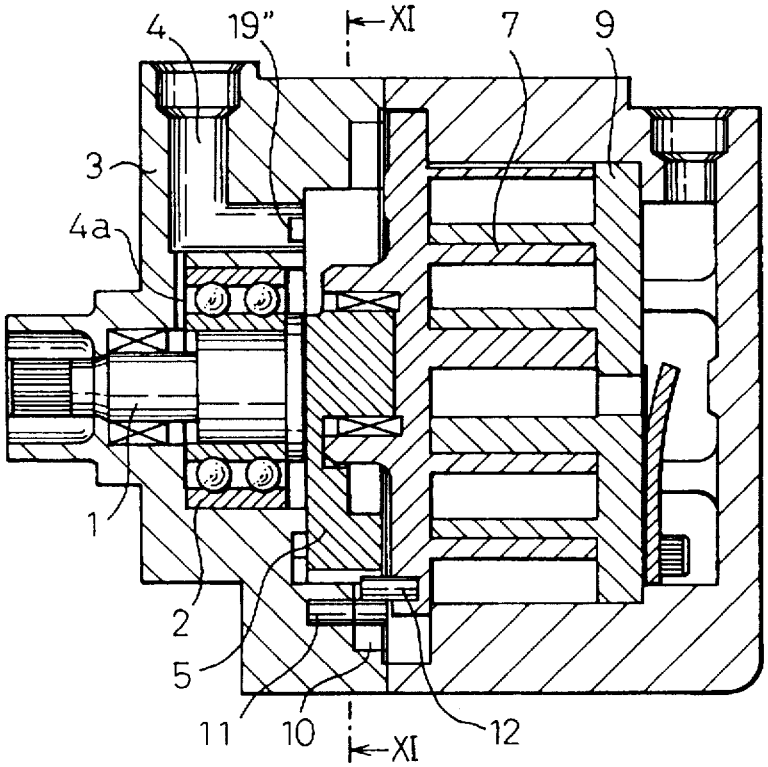
FIG. 10 is a vertical cross-sectional front view showing the scroll type compressor according to a sixth embodiment.
Figure 11:
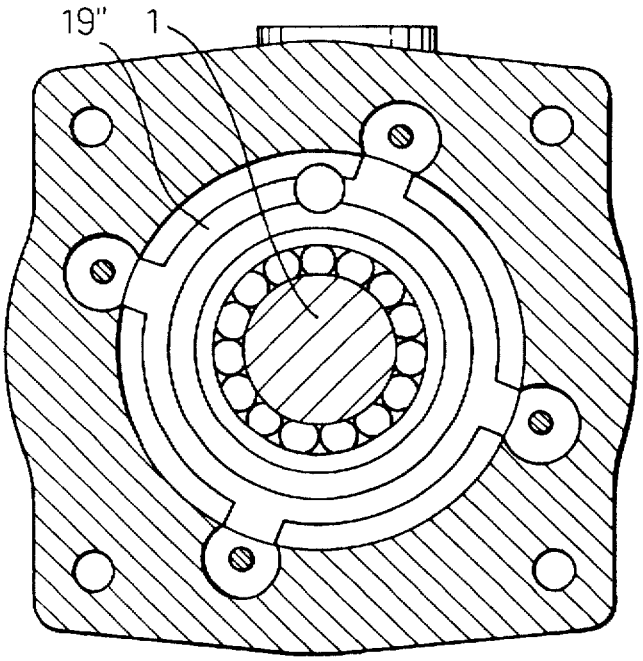
FIG. 11 is a horizontal cross-sectional side view taken along a line XI—XI of the scroll type compressor shown in FIG. 10.

In the first to fifth embodiments, for the supply of the lubricant by the annular intake grooves 19 and 19', the revolution movement of the rotor 7 was utilized, but a similar effect is exhibited even if an annular intake groove 19" is disposed in the end surface of the front housing 3 on which the end surface of the weight portion 5 slidably moves so that the lubricant contained in the refrigerant can be made to flow by utilizing the rotation movement of the weight portion 5 of the shaft 1 as in the sixth embodiment shown in FIG. 10 and FIG. 11.

We claim:

1. A scroll compressor comprising:

a housing structure defining an interior cavity therein, an intake port extending axially through a wall of said housing structure and communicating with said interior cavity for introducing a compression fluid into said interior cavity;

a drive shaft rotatably supported by said housing structure and having an eccentric crank portion;

a rotor rotatably supported on said crank portion within said interior cavity and having an end plate;

a rotation prevention mechanism operatively engaged with said end plate of said rotor and constructed and arranged to prevent said rotor from rotating about its own axis of rotation when said drive shaft rotates about its axis of rotation and to cause said rotor to orbit about the axis of rotation of said drive shaft when said drive shaft rotates about its axis of rotation, said rotation prevention mechanism having a plurality of mutually contacting sliding parts; and a stator fixed to said housing structure and having an end plate, said stator cooperating with said rotor to compress the fluid introduced into said interior cavity when said rotor orbits about the axis of rotation of said drive shaft, wherein a continuous annular intake groove is formed in a one of said end plate of said rotor and an interior end surface of said housing structure facing said end plate of said rotor, said annular intake groove communicating with said intake port, each of said plurality of sliding parts, and said interior cavity so that a lubricant entrained in said compression fluid is applied to each of said plurality of sliding parts as the compression fluid enters said interior cavity through said annular intake groove, and wherein said intake port and said rotor are constructed and arranged so that said intake port is blocked in an axial direction by a portion of said rotor once during each orbit of said rotor about the axis of rotation of said drive shaft to control flow of the compression fluid from said intake port directly into said interior cavity.

2. A scroll type compressor comprising:

a front housing;

a rear housing fixed to said front housing;

an intake port arranged in a one of said front housing and said rear housing, said intake port having an axial portion at its end terminating at an opening in an end surface of said one of said front housing and said rear housing and a radial portion preceding said axial portion, said intake port introducing a compression fluid into said compressor;

a shaft rotatably supported by said front housing and provided with a crank portion eccentric by a predetermined amount;

a rotor rotatably supported by said crank portion within said compressor and provided with a spiral blade and end plate;

a rotation prevention mechanism for preventing rotation of said rotor, said rotation prevention mechanism having a plurality of mutually contacting sliding parts; and a stator provided with a spiral blade and end plate the spiral blade thereof being engaged with the spiral blade of said rotor;

wherein said compressor includes an annular intake groove formed in a one of the end surface of said front housing and an end surface of said rotor which are opposite to each other, said annular intake groove communicating with said intake port and each of said plurality of sliding parts of said rotation prevention mechanism; and wherein said opening of said intake port is formed in a predetermined position in said one of said front housing and said rear housing so as to be blocked in an axial direction by said end plate of said rotor once during each orbit thereof.

3. A scroll type compressor as set forth in claim 2, wherein said intake groove is formed as an annular groove surrounding said shaft in the end surface of said front housing.

4. A scroll type compressor as set forth in claim 2, wherein said rotation prevention mechanism provides a plurality of pairs of rotation prevention pins.

5. A scroll type compressor as set forth in claim 4, wherein, in said rotation prevention mechanism, said pairs of rotation prevention pins are together inserted in circular recesses formed on the housing side, one of each of the pairs of said rotation prevention pins being fixed to said housing side, and the other of said pairs of rotation prevention pins being attached to the rotor side and contacting said one rotation prevention pins and revolving around the same and, at the same time, an intake groove for intake of the fluid to be compressed communicating the intake port and said rotation prevention mechanism is opened in said circular recesses.

6. A scroll type compressor as set forth in claim 2, wherein said rotation prevention mechanism comprises a pair of rings having holes and balls engaged with these holes.

7. A scroll type compressor as set forth in claim 2, wherein said crank portion comprises a driven crank mechanism having a variable eccentricity.

8. A scroll type compressor as set forth in claim 2, wherein said intake groove is annularly provided in the end plate of said rotor.

9. A scroll type compressor as set forth in claim 2, wherein said intake groove is formed in the part in the end surfaces of said front housing which is in contact with the weight portion rotating together with said shaft.

10. A scroll type compressor as set forth in claim 2, wherein said intake port is opened in said housing in front of the end plate of said rotor.

11. A scroll type compressor as set forth in claim 2, wherein the fluid to be compressed taken in said housing by said intake port is not substantially throttled and directly flows to said intake groove and is guided to the compression portion.

12. A scroll type compressor as set forth in any one of claims 2 to 11, wherein said intake port provides a branch path for lubricating the main bearing.

* * * * *